United States Patent [19]

Akao

[11] Patent Number: 4,991,502

[45] Date of Patent: Feb. 12, 1991

[54] DAMPING SYSTEM FOR AN OFFSET PRESS

[75] Inventor: Yoshiaki Akao, Tokyo, Japan

[73] Assignee: JPE Co., Ltd., Kitamoto, Japan

[21] Appl. No.: 418,752

[22] Filed: Oct. 5, 1989

Related U.S. Application Data

[63] Continuation of Ser. No. 248,442, Sep. 23, 1988, abandoned.

[51] Int. Cl.[5] ..... B41F 7/26; B41F 7/32

[52] U.S. Cl. ..... 101/148

[58] Field of Search ..... 101/348, 148, 349, 350, 101/351, 352, 207–210, 425

[56] References Cited

U.S. PATENT DOCUMENTS 4,686,901 8/1987 Arndt et al. ..... 101/148

*Primary Examiner*—J. Reed Fisher

*Attorney, Agent, or Firm*—Armstrong, Nikaido, Marmelstein, Kubovcik & Murray

[57] ABSTRACT

In the damping system for an offset press according to the present invention, the rotational speed of a motor, which drives a water-applicator roller, is controlled such that the difference or slip between the peripheral speed of the water-applicator roller and the peripheral speed of the plate cylinder can be set to a desired value. To this end the damping system comprises a water-applicator roller which applies water, supplied from another roller, to a plate cylinder of the offset press. The water-applicator roller is in contact with the plate cylinder. A motor drives the water-applicator roller. A detecting device detects the rotational speed of the motor. A device detects the peripheral speed of the plate cylinder. A slip input device sets a desired difference between the peripheral speed of the plate cylinder and the peripheral speed of the water-applicator roller. A control controls the rotational speed of the motor with the peripheral speed of the plate cylinder being modified by the difference set by the slip input device. In addition, a clutch is provided for disengaging the motor from the water-applicator roller when the difference is out of a predetermined range. The motor for driving the water-applicator roller is provided separately from a motor which drives the plate cylinder. A water-fountain roller, which is in contact with water in a water bath to supply water to the water-applicator roller, is driven by another motor.

3 Claims, 2 Drawing Sheets

DAMPING SYSTEM FOR AN OFFSET PRESS

This application is a continuation of application Ser. No. 248,442 filed Sept. 23, 1988, now abandoned.

BACKGROUND OF THE INVENTION

1. Field of the Invention

The present invention relates to an improvement of a damping system for an offset press, and more particularly to a damping or humidifying system for an offset press in which the peripheral speed between the water-applicator roller and the plate cylinder are different thereby hicky and ghosts are prevented from occurring and thus printing performance is improved.

2. Description of the Prior Art

In a conventional damping system of this type for an offset press, it is known to slightly decrease a peripheral speed of a water-applicator roller relative to that of a plate cylinder so as to reduce hicky and ghosts. More particularly, in the conventional damping system for the offset press, the water-applicator roller is also driven through gears by a main motor which drive the offset press such that the peripheral speed of the water-application roller is lower than that of the plate cylinder by a predetermined amount. In this case, a problem so called "gear seam" is made on the surface of printed matter due to the play of the gears. Furthermore, since the ratio between the peripheral speed of the water-applicator roller and the plate cylinder is determined by the gear ratio, the speed difference cannot be changed at will. Therefore, when the rotational speed of the plate cylinder is lower than a desired value, the peripheral speed difference is small, and thus hicky removal is poor. On the other hand, when the rotational speed of the plate cylinder is higher than a desired value, the peripheral speed difference is large, and thus the wear on the plate increases to shorten the life thereof. Due to this problem, it is necessary to change the gear ratio by replacement of the gears in order to provide a large number of products.

SUMMARY OF THE INVENTION

It is therefor an object of the present invention to provide a damping system for an offset press, which makes it possible: to substantially completely prevent hicky and ghosts from occurring; without shortening the life of the plate cylinder. To this end, the difference between the peripheral speeds of the water-applicator roller and the plate cylinder is arranged to be manually arbitrarily set using a variable speed motor which drives the water-applicator roller. With such a variable peripheral speed difference or slip, it is now possible to be prepared for various types of the offset press to be produced.

In the present invention, in addition to the above mentioned variable speed difference, a clutch is provided between the water-applicator roller and the motor which drives the water-applicator roller. The clutch is controlled such that it is put in a disengaged state when the slip exceeds an upper limit thereby preventing abnormal wear of the plate cylinder due to abnormal peripheral speed difference.

Furthermore, in the present invention, the water-fountain roller is driven by another motor whose speed is variable independent of the water-applicator roller. Therefore, the rotational speed of the water-fountain roller can be controlled at will in correspondence with the variation of the amount of supplied water or humidity caused by the slip between the plate cylinder and the water-applicator roller.

DESCRIPTION OF THE PREFERRED EMBODIMENTS

Figure 1:
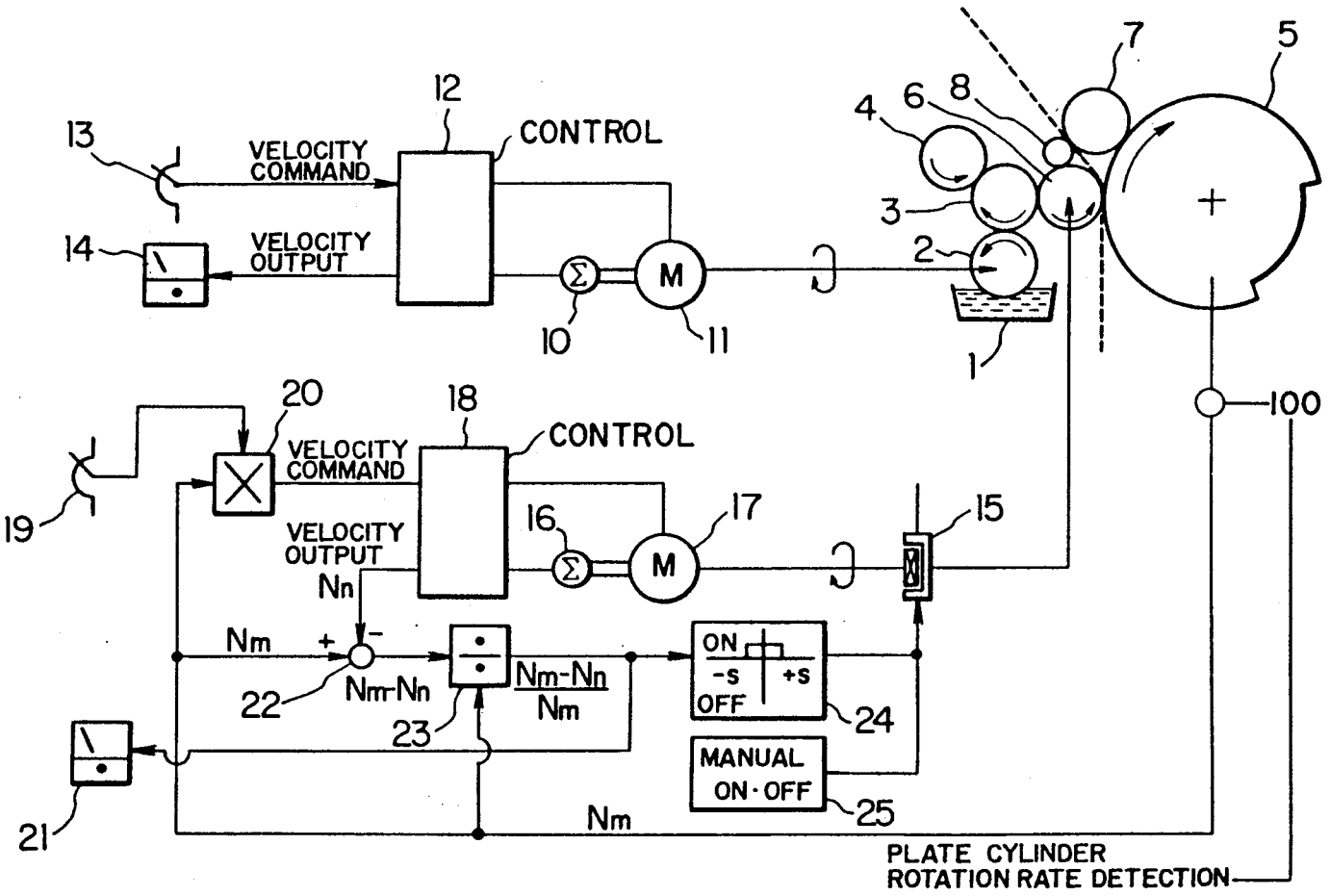
FIG. 1 is a functional block diagram of a first embodiment of the damping system of the present invention for an offset press.

Embodiments of a damping system of the present invention for an offset press will be hereinbelow described in detail with reference to the drawings which accompany and form a part of this specification or disclosure and in which like reference numerals denote corresponding parts throughout the views of the drawings.

In a first embodiment of the damping system of the present invention for the offset press, a water-fountain roller 2 is rotatably mounted in a water fountain 1. The water-fountain roller 2 is interlocked with a water-transfer roller 3 which is in turn interlocked with a water-stop roller 4. On the other hand, a water-applicator roller 6 is brought into contact with both of the water-transfer roller 3 and a plate cylinder 5. An oscillating roller 8 is brought into contact with both of the water-applicator roller 6 and an ink roller 7.

The water-fountain roller 2 is driven by a geared motor 11 with an encoder 10. The motor 11 is controlled in operation through a control circuit 12 responsive to an output signal from a water-fountain-roller velocity command dial 13A water-fountain-roller velocity indicator 14 is also provided.

On the other hand, the water-applicator roller 6 is driven by a geared motor 17 with an encoder 16 when an electromagnetic clutch 15 is in an engaged state. The motor 17 is controlled through a control circuit 18. When the clutch 15 is disengaged, the water-applicator roller 6 is driven by the plate cylinder 5 through a frictional contact therewith. The rotation speed of the geared motor 17 is controlled by an output signal from the control circuit 18 responsive to an output signal from a mixer 20. The mixer 20 is provided for modifying an output signal from a rotational speed sensor 100 which senses the peripheral speed of the plate cylinder 5 by using a desired slip input through a manually operable slip command dial 19. In this embodiment, the rotational speed represented by the output signal from the rotational speed sensor 100 is multiplied by the slip from the slip command dial 19 to obtain a velocity command signal which is input to the control circuit 18.

The encoder produces an output signal indicative of the rotational speed of the motor 17, and this output signal is input via the control circuit 18 to a subtractor 22 to which the output signal from the rotational speed sensor 100 is also input. The subtractor 22 produces an output signal indicative of the speed difference between the plate cylinder 5 and the geared motor 17. This difference signal is processed through an arithmetic circuit 23 to which the output signal from the rotational speed sensor 100 is also applied. In this embodiment, the arithmetic circuit 23 is a divider so that a difference $(N_m - N_n)$ is divided by the peripheral speed $N_m$ of the plate cylinder 5. An automatic clutch on/off circuit 24 is responsive to the output signal from the arithmetic circuit 23, and detects whether or not the value represented by the output signal from the arithmetic circuit 23 is within a given range. This given range is between a negative value corresponding to −10% and a positive value corresponding to +10% relative to zero slip. When the detected slip is within the range, i.e., between +10% and −10%, the clutch 15 is controlled to maintain an engaged state. On the other hand, when the slip is out of this range, i.e., over +10% or below −10%, the clutch is controlled to be in a disengaged state. With this arrangement, the slip or difference between the plate cylinder 5 and the water-applicator roller 6 is always kept within the abovementioned range. A manual clutch on/off switch 25 is also provided.

In this first embodiment of the present invention shown in FIG. 1, a water-fountain-roller velocity command is produced by means of the water-fountain-roller velocity dial 13, and is input to the control circuit 12 so that the geared motor 11 is driven at a desired rotational speed manually set to drive the water-fountain roller 2. At this time, the higher the rotational speed of the water-fountain roller 2, the larger the amount of water to be applied to the surface of the plate cylinder 5 through the water-transfer roller 3 and the water-applicator roller 6.

On the other hand, the encoder 10 detects the rotational speed of the geared motor 11 to issue a signal representing the rotational speed of the geared motor 11. This signal is fed back to the control circuit 12 which then compares the signal with a preset value to cause the geared motor 11 to rotate at a preset rotational speed so that the water-fountain roller 2 is rotated at a preset rotational speed corresponding to that of the geared motor 11. The rotational speed of the water-fountain roller 2 is indicated by means of the water-fountain-roller velocity indicator 14.

A slip command is manually set by the slip command dial 19 and is input as a signal to the mixer 20 which determines, based on this signal and the rotational speed "$N_m$" of the plate cylinder 5 to supply a velocity command to the control circuit 18.

As a result, the geared motor 17 rotates at the thus commanded velocity to drive the water-applicator roller 6 at a rotational speed corresponding to the commanded velocity of the geared motor 17, through the clutch 15.

On the other hand, the encoder 16 detects the rotational speed of the geared motor 17 to supply a signal to the control circuit 18. As a result, the control circuit 18 causes the geared motor 17 to rotate at the thus commanded velocity in a stable manner, while the control circuit 18 outputs a velocity output signal "$N_n$" to the subtractor 22.

The subtractor 22 is responsive to the rotational speed $N_m$ of the plate cylinder 5 input from sensor 100, and produces a difference $(N_m-N_n)$ by subtracting the velocity output signal $N_n$ from the rotational speed signal $N_m$ of the plate cylinder 5. The difference $(N_m-N_n)$ is input to the arithmetic circuit 23 to computer $(N_m-N_n)/N_m$. The result of this computation is fed to the automatic clutch on/off circuit 24 and also to the slip indicator 21. The value indicated by $(N_m-N_n)/N_m$ corresponds to the slip of the water-applicator roller 6 relative to the peripheral speed of the plate cylinder 5. The automatic clutch on/off circuit 24 detects whether the slip is within a range defined between +10% to −10%. When the slip is within this range, the clutch 15 is kept engaged. When the slip is out of this range, i.e., when the slip is either smaller than −10% or larger than +10%, the automatic clutch on/off circuit 24 produces an output signal which causes the clutch to be put in a disengaged state. As a result, the clutch 15 is automatically disengaged to separate the water-applicator roller 6 from the geared motor 17 so that a printing surface of the plate cylinder 5 is prevented from being damaged. The above-mentioned values −10% and +10% used for defining the range may be changed if desired.

Figure 2:
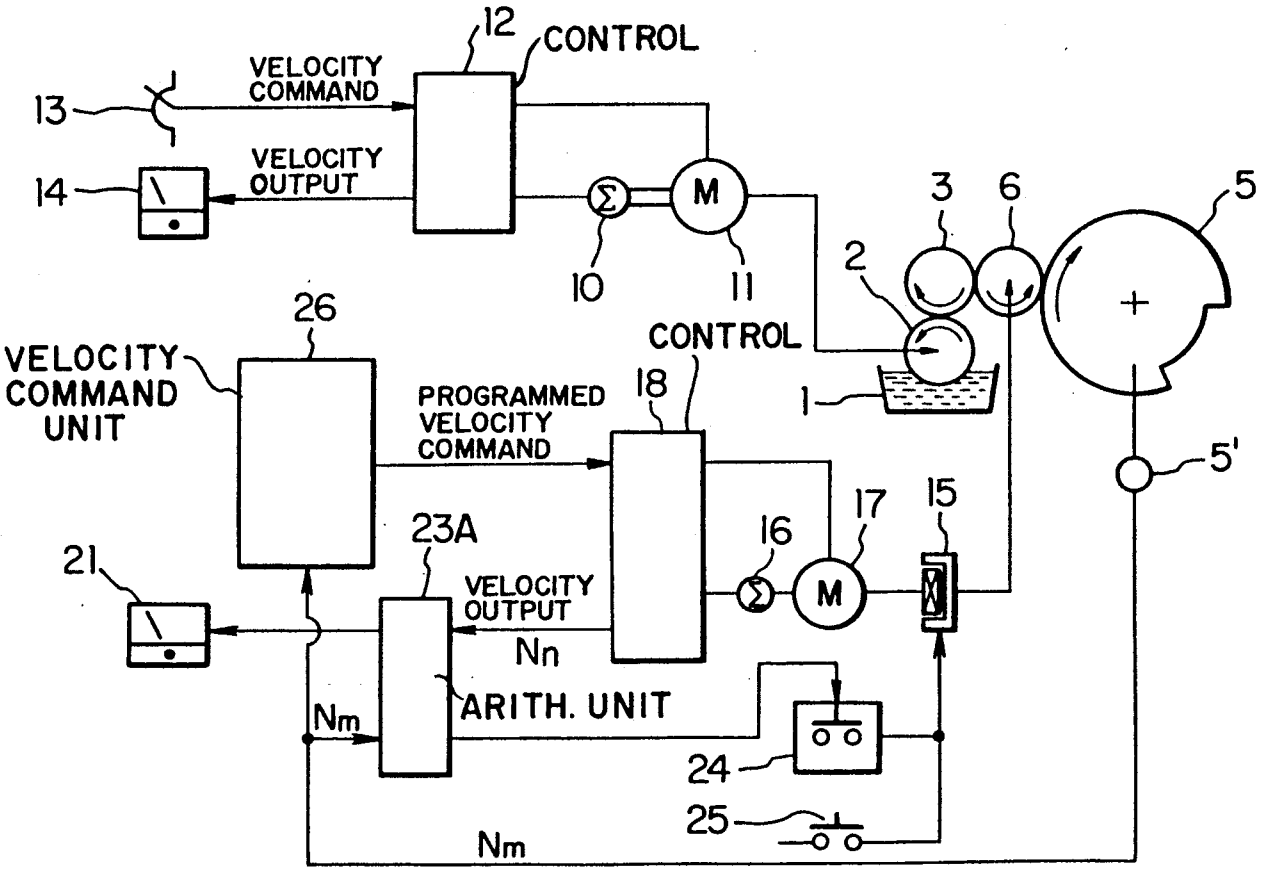
FIG. 2 is a functional block diagram of a second embodiment of the damping system of the present invention for an offset press.

Now, a second embodiment of the damping system of the present invention for the offset press will be described hereinbelow with reference to FIG. 2. The second embodiment of the present invention is different from the first embodiment of the present invention shown in FIG. 1 in that the water-applicator roller 6 is operated through a predetermined control. The remaining construction of the second embodiment of the present invention is similar to the first embodiment shown in FIG. 1. In order to eliminate redundancy in description, the remaining construction of the present invention is not described in detail as to the second embodiment of the present invention.

In the second embodiment of the present invention, a programmed velocity command previously in a velocity-command unit 26 is output therefrom to the control circuit 18 so as to operate the geared motor 17 at a predetermined rotational speed. As a result, the water-applicator roller 6 is driven by the thus operated geared motor 17 at a rotational speed corresponding to the predetermined rotational speed of the of geared motor 17.

On the other hand, the encoder 16 detects the rotational speed of the geared motor 17 to input a signal back to the control circuit 18 so as to operate the geared motor 17 at the programmed rotation rate in a stable manner. The signal fed from the encoder 16 is also input to the indicator 21 to display the rotational speed of the geared motor 17. In the arithmetic unit 23A, a determination is made based on the basis of the rotation rate "$N_m$" of the plate cylinder 5 detected by an rotational speed sensor 5' and the velocity output signal "$N_n$" is issued from the control circuit 18 as in the first embodiment. The result of the determination is input as a signal from the arithmetic unit 23A to the automatic clutch on/off circuit 24. At this time, when the signal input to the automatic clutch on/off circuit 24 is out of the predetermined range, the clutch 15 is disengaged to automatically separate the water-applicator roller 6 from the geared motor 17 so that the printing surface of the plate cylinder 5 is prevented from being damaged.

In the damping system of the present invention for the offset press, it is possible to vary the peripheral speed of the water-applicator roller 6 so as to be lower or higher than that of the plate cylinder 5 in a stepless manner, to make it possible to sufficiently remove the foreign particles deposited on the printing plate during the printing operation and also to substantially completely remove hicky and to prevent from occurring.

By slightly increasing or decreasing the peripheral speed of the water-applicator roller 6 relative to that of the plate cylinder 5, it is possible to prevent hicky and ghosts from occurring. In addition, according to the present invention, the rotational speed of not only the water-applicator roller 6 but also the water-fountain roller 2 can be controlled relative to the peripheral speed of the plate cylinder 5 or relative to the rotational speed of the water-applicator roller 6. Consequently, in contrast with the conventional damping system in which the rotational speed of the water-applicator roller relative to that of the plate cylinder is preset, the damping system of the present invention permits the water-applicator roller 6 or the water-fountain roller 2 to independently rotate at any rotational speed so that it is possible: to substantially completely prevent hicky and ghosts from occurring.

In addition, in the damping system of the present invention, since any of the water-fountain roller 2 and the water-applicator roller 6 is driven independently of the main motor of the offset press, there is no problem that the damping system of the present invention imposes an additional load on the main motor of the offset press.

What is claimed is:

1. A damping system for an offset press comprising:

a plate cylinder, a water-applicator roller for applying water, means for supplying water to said water-applicator roller, said water-applicator roller being in contact with said plate cylinder;

a motor driving said water-applicator roller;

motor speed detecting means for detecting a rotational speed of said motor;

peripheral speed detecting means for detecting a peripheral speed of said plate cylinder;

slip input means for setting a desired difference between the peripheral speed of said plate cylinder and a peripheral speed of said water-applicator roller; and control means connected to said motor speed detecting means, said peripheral speed detecting means and said slip input means for controlling the rotational speed of said motor with said peripheral speed of said plate cylinder, said rotational speed being modified by said desired difference set by said slip input means.

2. A damping system as claimed in claim 1, further comprising:

clutch means including a clutch engageably connected between said motor and said water-applicator roller, responsive to a control signal, for transmitting a rotational force of said motor to said water-applicator roller when said clutch is in an engaged state;

range detecting means, responsive to the rotational speed of said motor and said peripheral speed of said plate cylinder, for detecting whether said difference therebetween is within a predetermined range;

clutch control means, responsive to said range detecting means, for producing said control signal such that said control signal causes said clutch means into said engaged state only when said difference is within said range.

3. A damping system as claimed in claim 1, wherein said means for supplying water comprises a water-fountain roller and a motor for driving said water-fountain roller.

* * * * *

UNITED STATES PATENT AND TRADEMARK OFFICE

CERTIFICATE OF CORRECTION

PATENT NO. : 4,991,502

DATED : February 12, 1991

INVENTOR(S) : Yoshiaki AKAO

It is certified that error appears in the above-identified patent and that said Letters Patent is hereby corrected as shown below:

On the title page: after item [22], the following should appear:

[30] Foreign Application Priority Data

Feb. 27, 1988 [JP] Japan .....63-45499
Sept.25, 1987 [JP] Japan .....62-242284--

Signed and Sealed this

Eighth Day of December, 1992

*Attest:*

DOUGLAS B. COMER

*Attesting Officer*

*Acting Commissioner of Patents and Trademarks*